US008641226B2

(12) United States Patent
Yeh

(10) Patent No.: US 8,641,226 B2
(45) Date of Patent: Feb. 4, 2014

(54) FLASHLIGHT LAMP ROTATION STRUCTURE

(75) Inventor: Hsueh-Chu Yeh, Tainan (TW)

(73) Assignee: Shih-Hao Wang, Tainan (TW)

( * ) Notice: Subject to any disclaimer, the term of this patent is extended or adjusted under 35 U.S.C. 154(b) by 135 days.

(21) Appl. No.: 13/423,352

(22) Filed: Mar. 19, 2012

(65) Prior Publication Data

US 2013/0242547 A1 Sep. 19, 2013

(51) Int. Cl.
*F21L 4/00* (2006.01)

(52) U.S. Cl.
USPC ..... 362/197; 362/188; 362/171; 362/177

(58) Field of Classification Search
USPC ..... 362/197, 198, 199, 171, 177, 202, 188
See application file for complete search history.

(56) References Cited

U.S. PATENT DOCUMENTS

| | | | | |
|---|---|---|---|---|
| 5,765,937 | A * | 6/1998 | Shiau | 362/187 |
| 6,802,623 | B1 * | 10/2004 | Hsu et al. | 362/199 |
| 7,967,467 | B2 * | 6/2011 | Devaney et al. | 362/197 |
| 2005/0073837 | A1 * | 4/2005 | Jian | 362/199 |
| 2011/0182062 | A1 * | 7/2011 | Wilson | 362/197 |

* cited by examiner

*Primary Examiner* — Ali Alavi
(74) *Attorney, Agent, or Firm* — Alan Kamrath; Kamrath IP Lawfirm, PA

(57) ABSTRACT

A flashlight lamp rotation structure capable of rotating the direction of a lamp to meet the need for a flashlight illumination direction includes the lamp equipped with an illumination light source and movably pivotally coupled to the upper end of a flashlight body. The illumination light source in the lamp coupled to the upper end of the flashlight body can undergo a preset change of the color of lamp light, or the lamp can rotate in a preset direction, so as to provide illumination flexibly.

6 Claims, 11 Drawing Sheets

FLASHLIGHT LAMP ROTATION STRUCTURE

BACKGROUND OF THE INVENTION

1. Field of the Invention

The present invention relates to flashlight lamp rotation structures, and more particularly, to a flashlight lamp rotation structure that essentially comprises a lamp which is equipped with an illumination unit and disposed at the upper end of a flashlight and is capable of rotating in an illumination direction as needed, so as to enhance the flexibility of the use of the flashlight.

2. Description of Related Art

At present, flashlights designed by the industrial sector come in a wide variety of forms. A conventional flashlight usually comprises: a flashlight body for holding several batteries therein; a lamp equipped with an illumination unit and disposed at the upper end of the flashlight body; and a power switch coupled to the flashlight body, positioned in a manner to face a preset direction, and adapted to control the illumination unit to switch between ON and OFF. The flashlight with the aforesaid constituent components provides illumination at night or in an environment where vision is limited.

However, the lamp of the conventional flashlight in operation emits light in the direction of the flashlight body only, but cannot rotate. As a result, application of the flashlight is limited.

BRIEF SUMMARY OF THE INVENTION

The present invention is aimed at overcoming a drawback of the prior art, that is, a conventional lamp, which is equipped with an illumination unit therein and disposed at one end of a conventional flashing serving an illumination purpose, emits light in a fixed direction only and thus lacks ease of use. To this end, the present invention provides a flashlight lamp rotation structure that essentially comprises a lamp which is equipped with an illumination light source and movably pivotally coupled to the upper end of a flashlight body and is capable of rotating as appropriate according to the flashlight illumination direction, such that the illumination light source inside the lamp disposed at the upper end of the flashlight body can undergo a preset change of the color of lamp light, or the lamp can rotate in a preset direction to switch flexibly to a desirable illumination direction.

The first objective of the present invention is to provide a flashlight lamp rotation structure that comprises: a flashlight body having an upper end concavely defined with an accommodating region of a preset width; a rotatable body provided concavely therein with a receiving space; a connecting element inserted into the rotatable body and having at least two sides each coupled to an illumination light source; a lever penetrating the upper end of the flashlight body and the rotatable body; a receiving ring member screwed to a thread segment at the upper end of the rotatable body; and a transparent lampshade engaged with the receiving ring member. The rotatable body can be disposed on the accommodating region concavely disposed at the upper end of the flashlight body. Through holes of preset diameters are formed at the centers of support segments which flank the accommodating region of the flashlight body, respectively, such that tube segments extending outward from the two sides of the rotatable body can be inserted between the support segments. A curved concave portion is formed on the outer surface of the rotatable body laterally to abut against a limiting element received in the cavity, which is formed in the flashlight body and facing a preset direction, and pushed outward by a spring. The lever coupled to the spring is inserted between the tube segment on one side of the rotatable body and the through hole formed in the flashlight body and corresponding in position to the tube segment. A mask encloses the lever. The mask is fixed to the flashlight body.

A connecting element having a surface concavely provided with at least two recesses facing preset directions is received in a receiving space of the rotatable body. A penetrating hole is formed at the center of the connecting element to penetrate the connecting element. Hence, the lever abutting against the flashlight body resiliently can be moved and inserted into the penetrating hole at the center of the connecting element or withdrawn from the penetrating hole resiliently. A protruding portion is formed on the receiving space-facing surface of the rotatable body to face a preset direction. The protruding portion is inserted into the recesses disposed concavely on the surface of the connecting element so as to restrict the direction of the connecting element appropriately. At least two limiting protruding portions extending outward from the rim of the connecting element in preset directions provide appropriate rotational restriction in conjunction with a stop segment formed at the rotatable body.

The thread segment at the upper end of the rotatable body is screwed to the receiving ring member, and a transparent lampshade is engaged with the upper end of the receiving ring member, such that a flashlight capable of lamp rotation can be assembled. Hence, regarding the lamp equipped with an illumination light source and movably pivotally coupled to the upper end of the flashlight body, the illumination light source coupled to the lamp and disposed therein can undergo a preset change of the color of lamp light, or the lamp can rotate in a preset direction required for the illumination provided by the flashlight, so as to enable the flashlight to provide illumination flexibly.

The second objective of the present invention is to provide a spacer inwardly coupled to a receiving ring member screwed to a thread segment at the upper end of a rotatable body of a lamp equipped with an illumination light source and movably pivotally coupled to the upper end of a flashlight body, such that a lamp cap disposed at the upper end of the receiving ring member can move downward, so as to avoid colliding with the connecting element inserted into the rotatable body when rotated.

The third objective of the present invention is to provide a lamp equipped with an illumination light source and movably pivotally coupled to the upper end of a flashlight body, such that a connecting element is inserted into the rotatable body, and the illumination light sources coupled to a periphery of at least two sides of the connecting element emit white light and yellow light.

The fourth objective of the present invention is to provide a rotatable body movably pivotally coupled to a lamp equipped with an illumination light source and disposed at the upper end of a flashlight body, such that at least two recesses spaced apart by 90 degrees in terms of their angular relationship and facing preset directions, respectively, are concavely disposed on the surface of the connecting element.

The fifth objective of the present invention is to provide a lamp equipped with an illumination light source and movably pivotally coupled to the upper end of a flashlight body, such that a cover can be engaged with the through hole of the support segment disposed on one side of the flashlight body and engaged with the tube segment extending from the other side of the rotatable body.

The sixth objective of the present invention is to provide a lamp equipped with an illumination light source and movably pivotally coupled to the upper end of a flashlight body, such that at least two limiting protruding portions extending outward from the periphery of the connecting element inserted into a rotatable body are long, whereas the protruding portion disposed between the at least two limiting protruding portions and corresponding in position to the range of rotation of the at least two limiting protruding portions is short. Hence, the protruding portion disposed in a preset direction in the rotatable body can stop the limiting protruding portions of the connecting element appropriately and pass each of the protruding portions at a rotational range of the connecting element smoothly.

DETAILED DESCRIPTION OF THE EMBODIMENTS OF THE INVENTION

Figure 1:
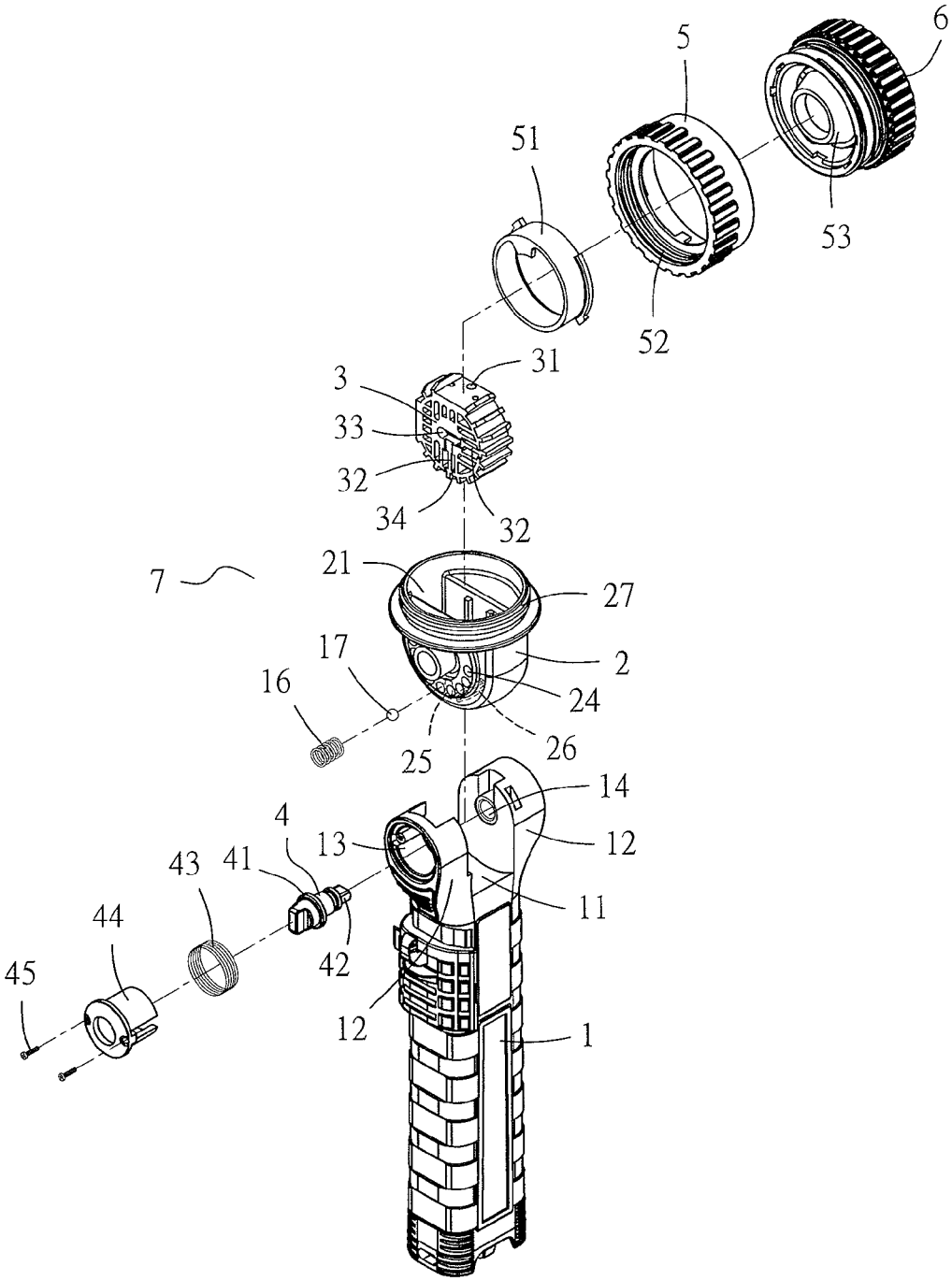
FIG. 1 is an exploded view of a flashlight lamp rotation structure according to the present invention.
Figure 2:
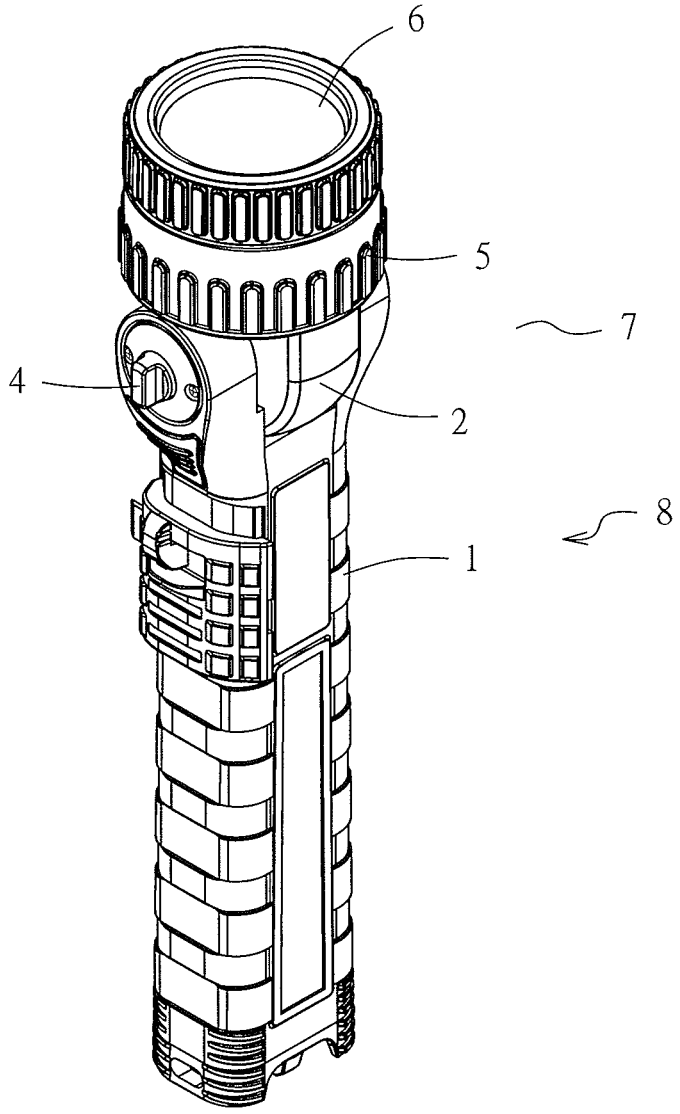
FIG. 2 is a perspective view of the flashlight lamp rotation structure according to the present invention.

Referring to FIG. 1, the present invention provides a flashlight lamp rotation structure essentially embodied by a lamp rotation structure 7 of a flashlight 8 (shown in FIG. 2). The flashlight lamp rotation structure comprises: a flashlight body 1 having an upper end concavely defined with an accommodating region 11 of a preset width; a rotatable body 2 provided concavely therein with a receiving space 21; a connecting element 3 inserted into the rotatable body 2 and having at least two sides each coupled to an illumination light source 31; a lever 4 penetrating the upper end of the flashlight body 1 and the rotatable body 2; a receiving ring member 5 screwed to a thread segment 27 at the upper end of the rotatable body 2; and a transparent lampshade 6 engaged with the receiving ring member 5.

The accommodating region 11 of a preset width is concavely defined at the upper end of the flashlight body 1. Through holes 13, 14 of preset diameters are formed at the centers of support segments 12 which flank the accommodating region 11, respectively. A cavity 15 (shown in FIG. 3 and FIG. 4) facing a preset direction is disposed in the flashlight body 1.

Figure 1A:
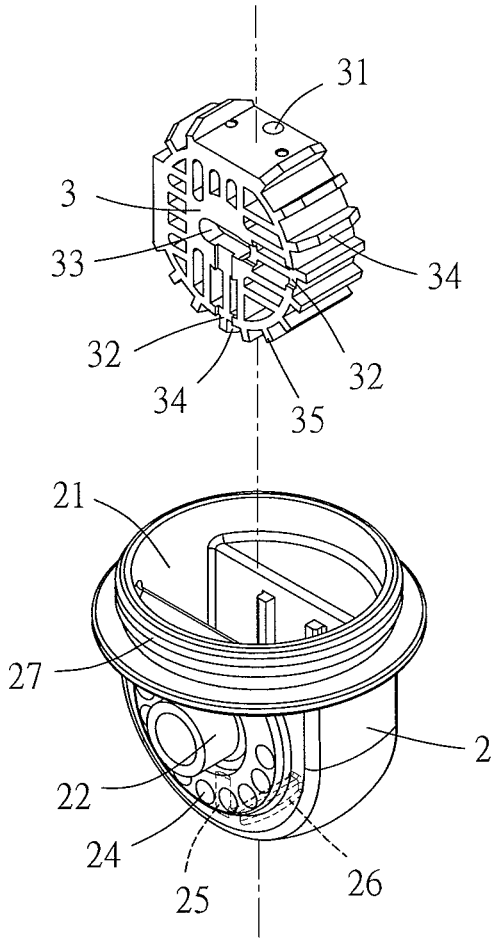
FIG. 1A is an enlarged view of two of the components shown in FIG. 1.

The rotatable body 2, which functions as a lamp rotation carrier, is designed according to the accommodating region 11 of the flashlight body 1. The receiving space 21 is concavely provided in the rotatable body 2. Tube segments 22, 23 (shown in FIG. 3 and FIG. 4) extend outward from the two sides of the rotatable body 2, respectively. A curved concave portion 24 (shown in FIG. 1 and FIG. 1A) is formed on the outer surface of the rotatable body 2 laterally. A protruding portion 25 is formed on the receiving space-facing surface of the rotatable body 2 to face a preset direction. A stop segment 26 is formed at the bottom of the receiving space 21. The thread segment 27 extends from the upper end of the rotatable body 2.

The connecting element 3, which carries the illumination light source 31, is designed according to the receiving space 21 of the rotatable body 2. The illumination light source 31 (capable of emitting white light and yellow light) is coupled to the horizontal surface on at least two edges of the connecting element 3. At least two recesses 32 (spaced apart by 90 degrees in terms of their angular relationship) facing preset directions, respectively, are concavely disposed on a surface of the connecting element 3 laterally. A penetrating hole 33 is formed at the center of the connecting element 3 to penetrate the connecting element 3. At least two limiting protruding portions 34 extend, outward and in preset directions, from the periphery of the connecting element 3. The at least two limiting protruding portions 34 are long, whereas a protruding portion 35 disposed between the at least two limiting protruding portions 34 and corresponding in position to the range of rotation of the at least two limiting protruding portions 34 is short.

The lever 4 has a switching section designed according to the flashlight body 1 and the rotatable body 2. A flange 41 is formed at a preset section of the lever 4 for imposing directional limitation upon a spring 43 in place. The end of the lever 4 forms a limiting segment 42. The limiting segment 42 is shaped according to the penetrating hole 33 at the center of the connecting element 3. A mask 44 is provided to enclose the lever 4. The mask 44 is fixed to the flashlight body 1 by means of screwing elements 45.

The receiving ring member 5, which is a lampshade connection element, is designed according to the thread segment 27 at the upper end of the rotatable body 2. A spacer 51 is coupled to the receiving ring member 5 from inside. An internal thread 52 is formed at the lower portion of the receiving ring member 5.

The transparent lampshade 6, which shades a light source of a flashlight, is designed according to the receiving ring member 5. The lower end of the transparent lampshade 6 is engaged with an inner rim of the receiving ring member 5.

Figure 3:
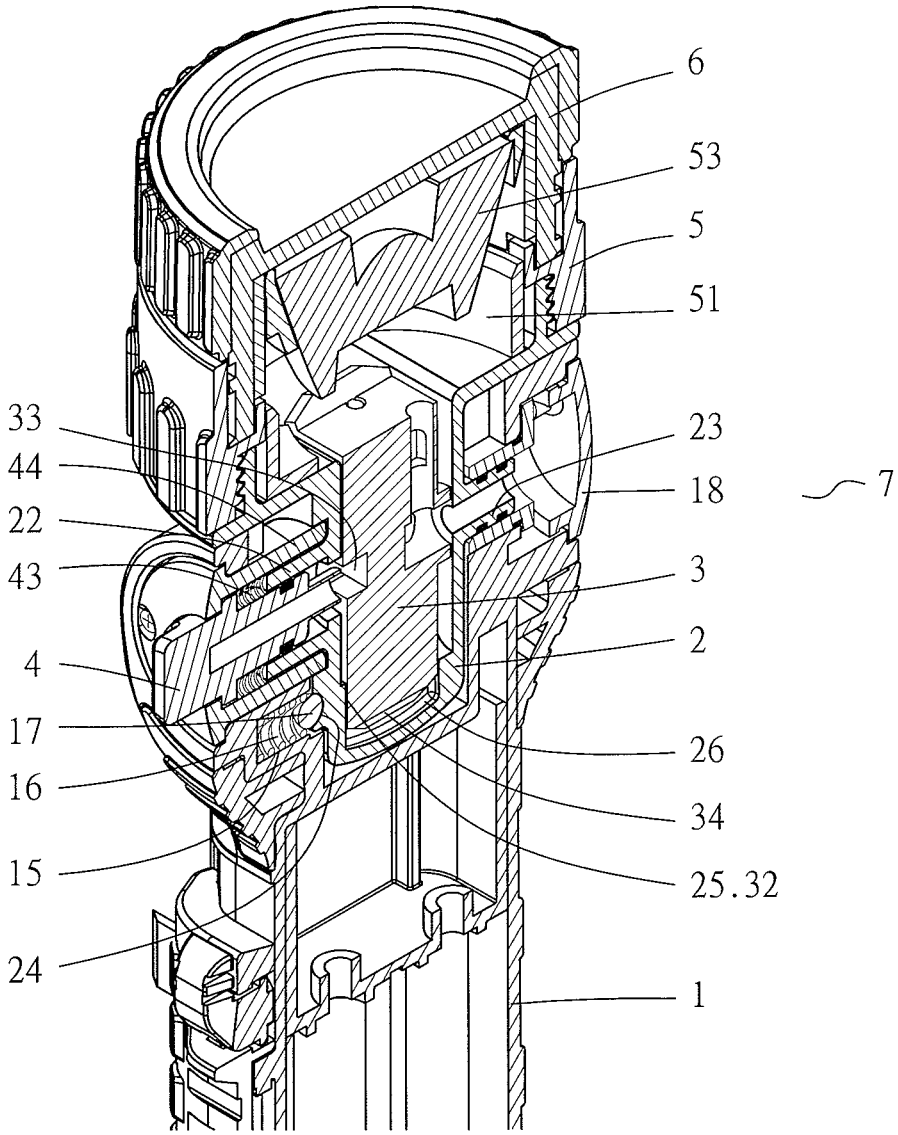
FIG. 3 is a cutaway view of the flashlight lamp rotation structure according to the present invention.
Figure 4:
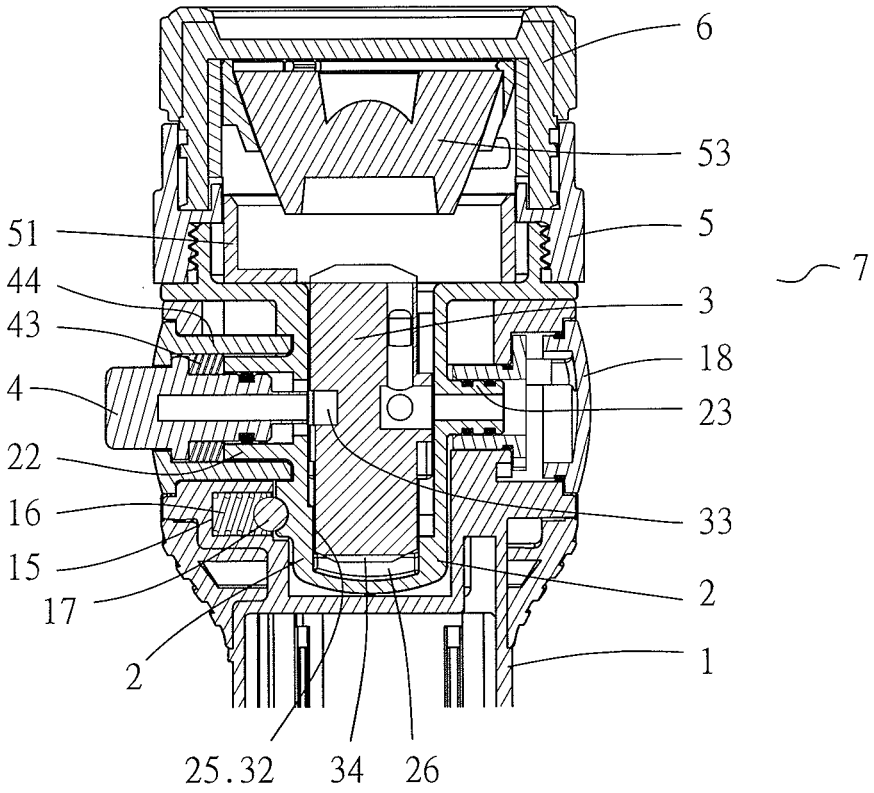
FIG. 4 is a partial front cross-sectional view of the flashlight lamp rotation structure according to the present invention.

An assembly process whereby the flashlight body 1, the rotatable body 2, the connecting element 3, the lever 4, the receiving ring member 5, and the transparent lampshade 6 are put together (as shown in FIG. 3 and FIG. 4) entails performing the steps as follows:

Step 1: insert the connecting element 3 into the receiving space 21 inside the rotatable body 2 while the recesses 32 disposed laterally on the surface of the connecting element 3 are being guided by the protruding portion 25 formed on the rotatable body 2 in a preset direction so as to limit the direction of the connecting element 3 appropriately, wherein the stop segment 26 in the receiving space 21 of the rotatable body 2 abuts against the at least two limiting protruding portions 34 extending outward from the rim of the connecting element 3 to restrict the rotation of the connecting element 3 appropriately.

Step 2: put the rotatable body 2 coupled to the connecting element 3 in the accommodating region 11 defined at the upper end of the flashlight body 1, and insert the tube segments 22, 23 extending outward from the two sides of the rotatable body 2 into the through holes 13, 14 of the support segments 12 which flank the accommodating region 11 of the flashlight body 1, such that a spring 16 and a limiting element 17 which are received in the cavity 15 in the flashlight body 1 come into directional contact with the curved concave portion 24 formed on the outer surface of the rotatable body 2.

Step 3: put the lever 4 coupled to the spring 43 between the tube segment 22 on one side of the rotatable body 2 and the through hole 13 of the flashlight body 1, enclose the lever 4 with the mask 44, fix the mask 44 to the flashlight body 1 by means of the screwing elements 45 such that the lever 4 abutting against the flashlight body 1 resiliently can be moved and inserted into the penetrating hole 33 at the center of the connecting element 3 or withdrawn from the penetrating hole 33 resiliently, and eventually engage a cover 18 with the through hole 14 of the support segment 12 disposed on one side of the flashlight body 1 and engaged with the tube segment 23 on the other side of the rotatable body 2.

Step 4: screw the internal thread 52 of the receiving ring member 5 to the thread segment 27 at the upper end of the rotatable body 2, wherein a lamp cap unit 53 is disposed at the upper end of the receiving ring member 5, and then engage the transparent lampshade 6 with the upper end of the receiving ring member 5, so as to assemble the flashlight 8 having a rotatable lamp 71 (as shown in FIG. 2.)

Figure 5:
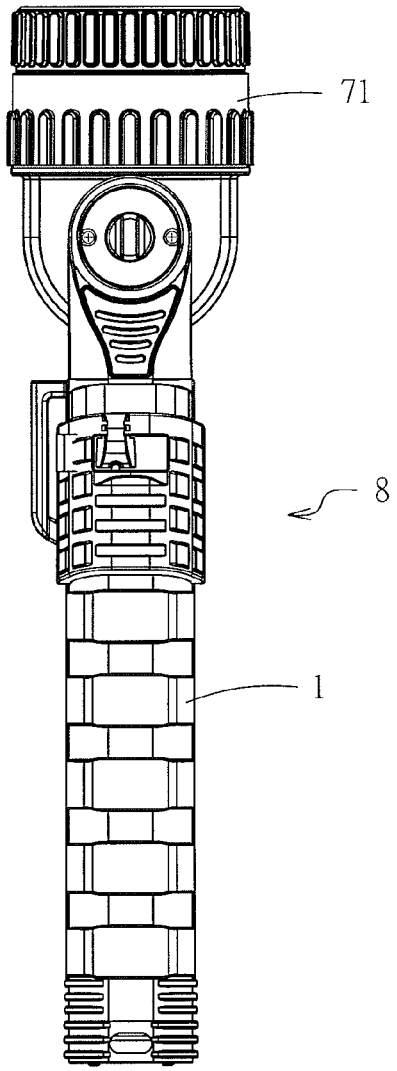
FIG. 5 is a schematic view of the flashlight lamp rotation structure when a lever thereof has not yet been pressed according to the present invention.
Figure 6:
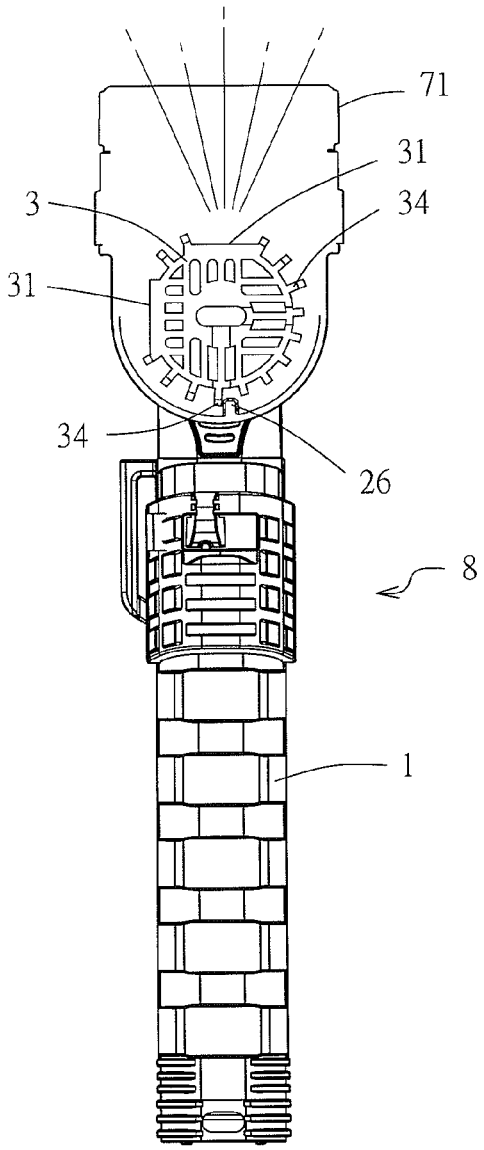
FIG. 6 is a schematic view of the flashlight lamp rotation structure when the lever thereof has not yet been pressed according to the present invention.

To perform the directional rotation of the lamp 71 movably pivotally coupled to the flashlight 8 of the lamp rotation structure 7 (as shown in FIG. 5 and FIG. 6), the user performs the directional rotation of the lamp 71 manually (in the direct indicated by the arrow shown in FIG. 7) to cause the rotatable body 2 to undergo angular displacement while the protruding portion 25 formed on the receiving space-facing surface of the rotatable body 2 is inserting into the recesses 32 disposed on the surface of the connecting element 3 so as to drive the connecting element 3 to rotate synchronously with the lamp 71; meanwhile, the at least two limiting protruding portions 34 of the connecting element 3 undergo directional displacement by means of the stop segment 26 in the rotatable body 2, such that the illumination light source 31 (emitting white light and) coupled to a preset periphery of the connecting element 3 rotates by 90 degrees to enable the flashlight 8 to provide illumination while being kept in the user's pocket but not held in the user's hand.

Figure 8:
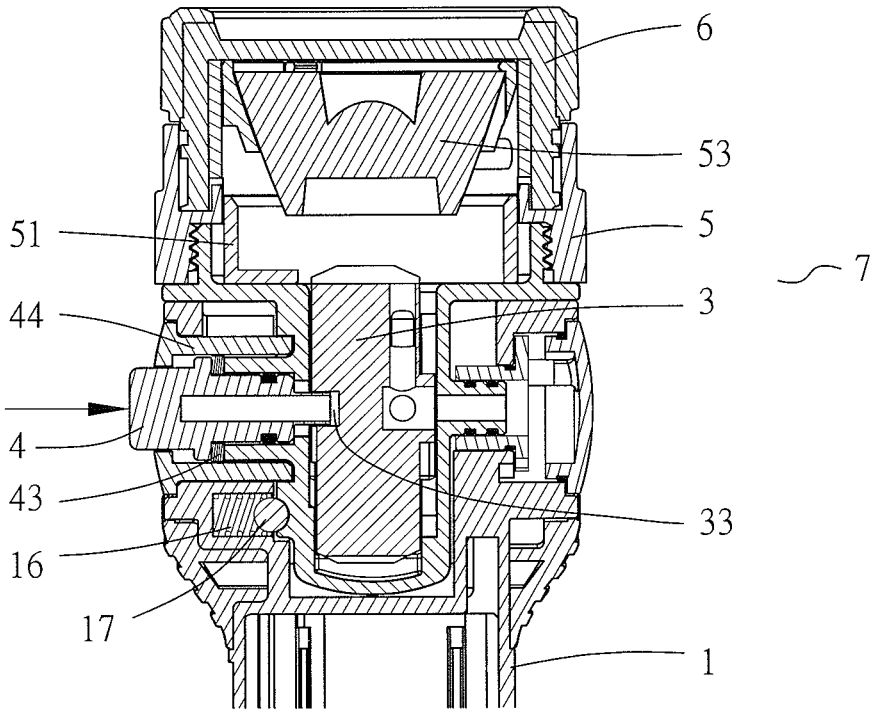
FIG. 8 is a partial front cross-sectional view of the flashlight lamp rotation structure with the lever pressed according to the present invention.
Figure 9:
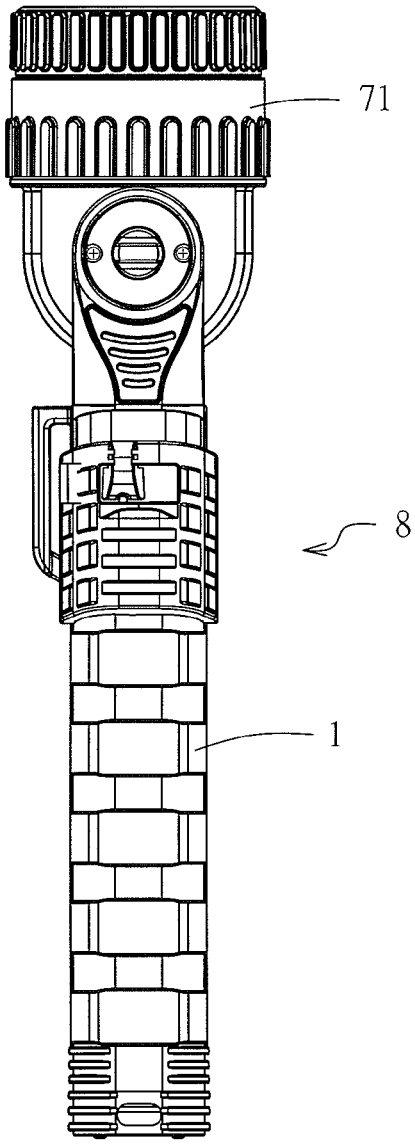
FIG. 9 is a schematic view of the flashlight lamp rotation structure with the lever pressed according to the present invention.
Figure 10:
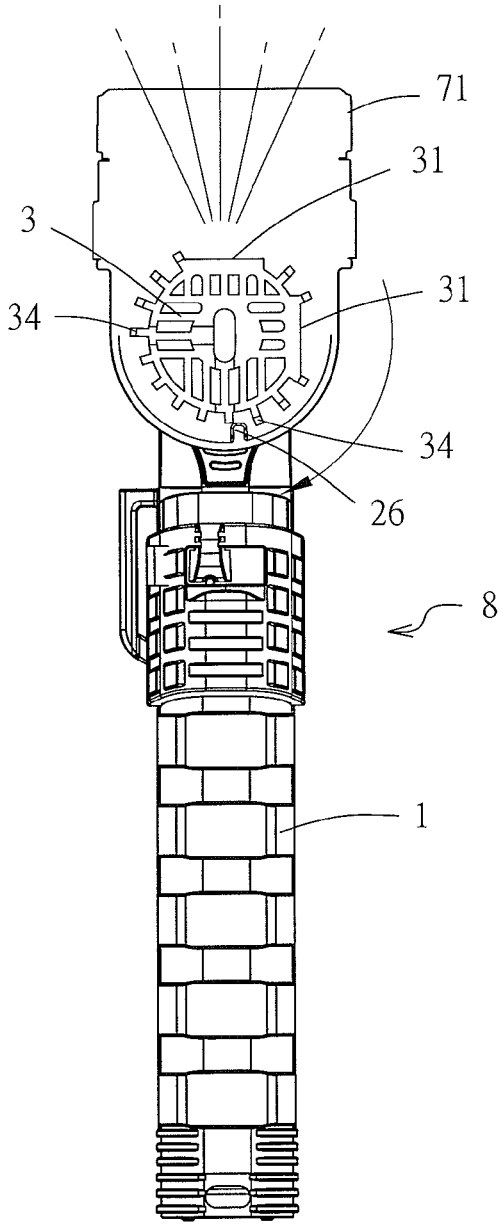
FIG. 10 is a schematic view of the flashlight lamp rotation structure with the lever pressed according to the present invention.

To enable the lamp 71 of the flashlight 8 movably coupled to the lamp rotation structure 7 to change the color of the lamplight emitted from the lamp 71 (as shown in FIG. 8 and FIG. 9,) the user presses the lever 4 abutting resiliently against the flashlight body 1 by hand to insert the lever 4 into the penetrating hole 33 at the center of the connecting element 3, such that the user's hand can rotate the lever 4 and drive the connecting element 3 to undergo displacement synchronously with the rotation of the lever 4; meanwhile, the recesses 32 of the connecting element 3 are disconnected from the protruding portion 25 of the rotatable body 2, and the protruding portion 25 of the rotatable body 2 abuts appropriately against the recess 32 facing the other direction again as soon as the connecting element 3 stops being moved (as shown in FIG. 10), such that the illumination light source 31 stops emitting white light and starts emitting yellow light. Afterward, the user releases his/her grip on the lever 4 to allow the lever 4 to restore its original position as a result of an outward stretch of the spring 43.

Figure 7:
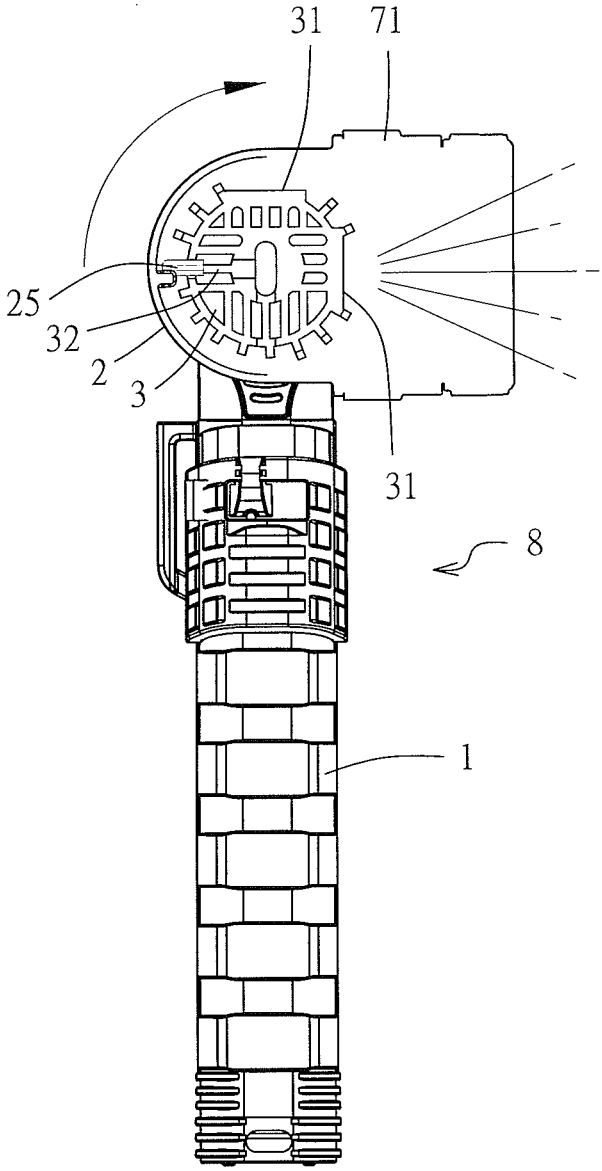
FIG. 7 is a schematic view of the flashlight lamp rotation structure with a rotatable lamp according to the present invention.
Figure 11:
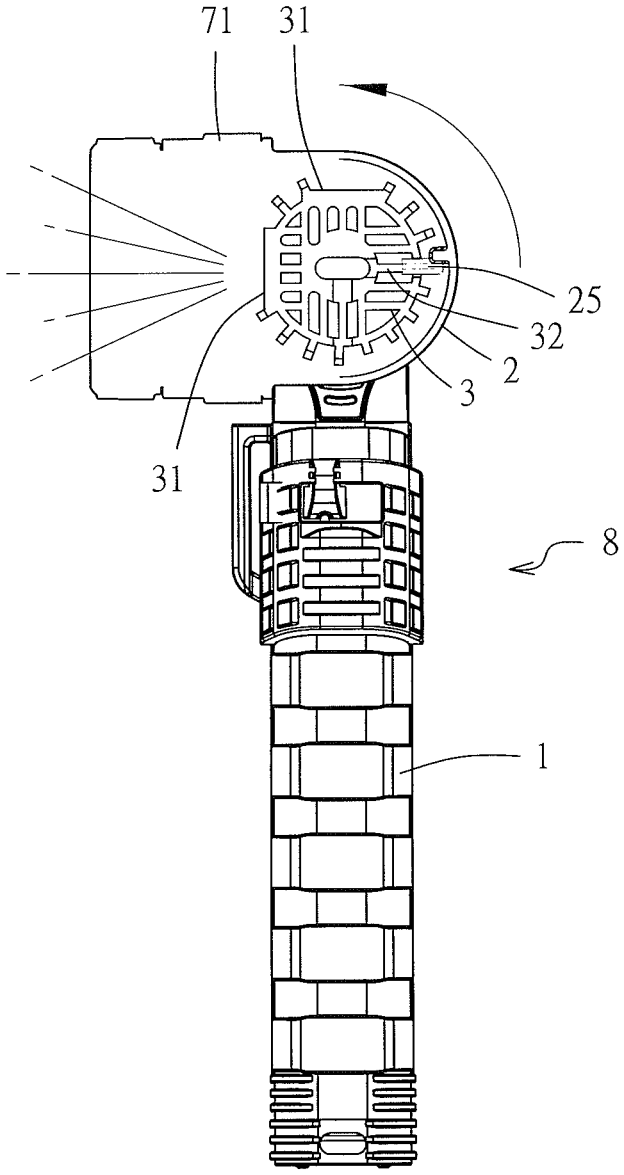
FIG. 11 is a schematic view of the flashlight lamp rotation structure with the rotatable lamp according to the present invention.

To rotate the lamp 71 which has switched from white light to yellow light by 90 degrees (as shown in FIG. 11), what the user has to do is exactly the same as what is depicted in FIG. 6 and FIG. 7 previously, that is, rotating the lamp 71 in an intended direction as needed, so as to drive the rotatable body 2 to undergo angular displacement and cause the connecting element 3 to rotate synchronously with the rotatable body 2, such that the illumination light source 31 can rotate by 90 degrees to provide illumination while being kept in the user's pocket but not held by the user's hand.

Regarding the lamp 71 equipped with the illumination light source 31 and movably pivotally coupled to the upper end of the flashlight body 1, the illumination light source 31 coupled to the lamp 71 and disposed therein can undergo a preset change of the color of lamp light, or the lamp 71 can rotate in a preset direction required for the illumination provided by the flashlight 8, so as to enable the flashlight 8 to provide illumination flexibly.

Figure 12:
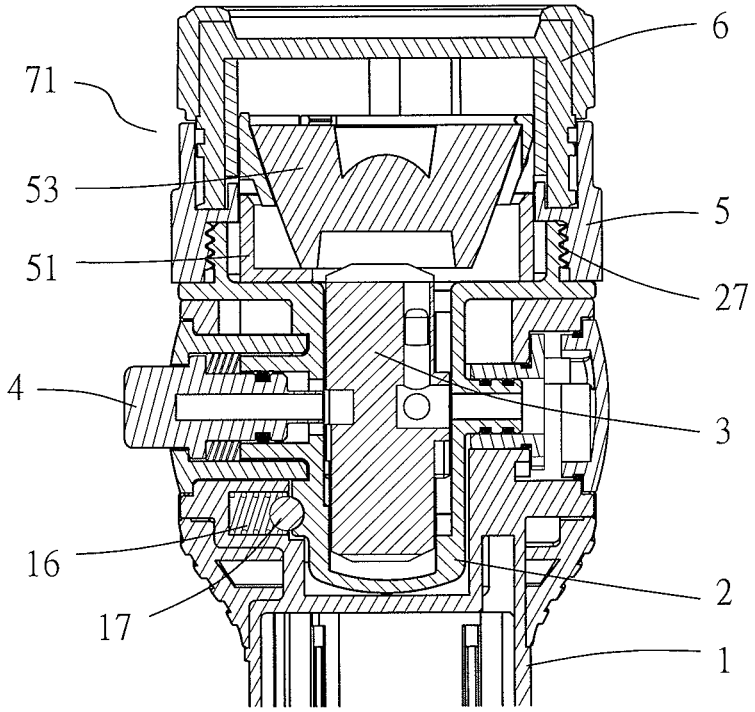
FIG. 12 is a cross-sectional view of the flashlight lamp rotation structure with a lamp cap moved downward according to the present invention.

The spacer 51, which is inwardly coupled to the receiving ring member 5 screwed to the thread segment 27 at the upper end of the rotatable body 2 of the lamp 71 equipped with the illumination light source 31 and pivotally coupled to the upper end of the flashlight body 1, allows the lamp cap unit 53 disposed at the upper end of the receiving ring member 5 to move downward (as shown in FIG. 12), so as to avoid colliding with the connecting element 3 inserted into the rotatable body 2 when rotated.

What is claimed is:

1. A flashlight lamp rotation structure, comprising:

a flashlight body having an upper end concavely defined with an accommodating region of a preset width;

a rotatable body provided concavely therein with a receiving space;

a connecting element inserted into the rotatable body and having at least two sides each coupled to an illumination light source;

a lever penetrating the upper end of the flashlight body and the rotatable body;

a receiving ring member screwed to a thread segment at the upper end of the rotatable body; and a transparent lampshade engaged with the receiving ring member, wherein the rotatable body is disposed on the accommodating region concavely defined at the upper end of the flashlight body, wherein through holes of preset diameters are formed at centers of support segments flanking the accommodating region of the flashlight body, such that tube segments extending outward from the two sides of the rotatable body, respectively, can be inserted into the through holes, wherein a curved concave portion is formed on an outer surface of the rotatable body laterally to abut against a limiting element received in the cavity formed in the flashlight body and facing a preset direction and pushed outward by a spring, wherein a lever coupled to the spring is inserted between the tube segment on one side of the rotatable body and the through hole formed in the flashlight body and corresponding in position to the tube segment, wherein a mask encloses the lever and is fixed to the flashlight body, wherein the connecting element having a surface concavely provided with at least two recesses facing preset directions is received in the receiving space of the rotatable body, wherein a penetrating hole is formed at a center of the connecting element to penetrate the connecting element, such that the lever abutting against the flashlight body resiliently can be moved and inserted into the penetrating hole or withdrawn from the penetrating hole resiliently, wherein a protruding portion is formed on the rotatable body to face a preset direction and inserted into the recesses disposed concavely on the surface of the connecting element so as to restrict the direction of the connecting element appropriately, wherein at least two limiting protruding portions extending outward from a rim of the connecting element in preset directions provide appropriate rotational restriction in conjunction with a stop segment formed at the rotatable body;

wherein the thread segment at the upper end of the rotatable body is screwed to the receiving ring member, and a transparent lampshade is engaged with the upper end of the receiving ring member, such that a flashlight capable of lamp rotation can be assembled, wherein the illumination light source coupled to the lamp movably pivotally coupled to the upper end of the flashlight body undergoes a preset change of a color of lamp light to meet a need for a flashlight illumination direction, or the lamp rotates in a preset direction, so as to provide flashlight illumination flexibly.

2. The flashlight lamp rotation structure of claim 1, wherein a spacer coupled to the receiving ring member from inside is screwed to the thread segment at the upper end of the rotatable body of the lamp equipped with the illumination light source and movably pivotally coupled to the upper end of the flashlight body, so as to allow the lamp cap unit disposed at an upper end of the receiving ring member to move downward and thereby avoid colliding with the connecting element inserted into the rotatable body when rotated.

3. The flashlight lamp rotation structure of claim 1, wherein the illumination light sources coupled to a periphery of at least two sides of the connecting element inserted into the rotatable body of the lamp equipped with the illumination light source and movably pivotally coupled to the upper end of the flashlight body emit white light and yellow light.

4. The flashlight lamp rotation structure of claim 1, wherein the at least two recesses concavely disposed on one side of the connecting element inserted into the rotatable body of the lamp equipped with the illumination light source and movably pivotally coupled to the upper end of the flashlight body are spaced apart by 90 degrees.

5. The flashlight lamp rotation structure of claim 1, wherein a cover is engaged with the through hole of the support segment disposed on one side of the flashlight body and engaged with the tube segment extending from the other side of the rotatable body.

6. The flashlight lamp rotation structure of claim 1, wherein the at least two limiting protruding portions extending outward from a periphery of the connecting element inserted into the rotatable body of the lamp equipped with the illumination light source and movably pivotally coupled to the upper end of the flashlight body are long, whereas the protruding portion disposed between the at least two limiting protruding portions and corresponding in position to the range of rotation of the at least two limiting protruding portions is short, such that the protruding portion disposed in a preset direction in the rotatable body can stop the limiting protruding portions of the connecting element appropriately and pass each of the protruding portions at a rotational range of the connecting element smoothly.

* * * * *